United States Patent [19]

Harreld et al.

[11] Patent Number: 4,951,318

[45] Date of Patent: Aug. 28, 1990

[54] PROTECTIVE GOWN WITH INTEGRAL TIE STRAPS

[75] Inventors: Donald R. Harreld, Woodstock; John J. Newton, Jr., Palatine, both of Ill.

[73] Assignee: Sage Products, Inc., Cary, Ill.

[21] Appl. No.: 473,100

[22] Filed: Feb. 1, 1990

Related U.S. Application Data

[63] Continuation of Ser. No. 270,246, Nov. 14, 1988, abandoned.

[51] Int. Cl.[5] ..... A41B 13/10

[52] U.S. Cl. ..... 2/49 R; 2/DIG. 7; 2/48; D2/226

[58] Field of Search ..... 2/46, 48, 49 R, 69, 2/DIG. 7, 114, 69.5, 50, 51, 52, 243 B; D2/226

[56] References Cited

U.S. PATENT DOCUMENTS

| | | | |
|---|---|---|---|
| D. 115,086 | 5/1939 | Spanel | 2/48 |
| D. 232,134 | 7/1974 | Andersson et al. | D2/226 |
| D. 233,275 | 10/1974 | Goldman | D2/226 |
| 699,238 | 5/1902 | Reed | D2/226 |
| 2,173,344 | 9/1939 | Spanel | 2/49 R |
| 2,282,547 | 5/1942 | Spanel | 2/48 |
| 3,452,363 | 7/1969 | Schultz | D2/226 |
| 3,911,499 | 10/1975 | Benevento | 2/DIG. 7 |
| 4,475,250 | 10/1984 | Savin | 2/49 R |
| 4,587,671 | 5/1986 | Rodriguez | 2/69 |
| 4,608,719 | 9/1986 | Lunt | 2/DIG. 7 |

FOREIGN PATENT DOCUMENTS

| | | | |
|---|---|---|---|
| 110263 | 4/1944 | Sweden | D2/226 |
| 2124888 | 2/1984 | United Kingdom | 2/49 R |

*Primary Examiner*—Werner H. Schroeder
*Assistant Examiner*—Diana L. Biefeld
*Attorney, Agent, or Firm*—Lee, Mann, Smith McWilliams & Sweeney

[57] ABSTRACT

A disposable protective gown with a pair of integral neck tie straps. The gown is composed of a body portion which extends over the shoulders of the wearer and which has a pair of sleeves which extend outwardly from opposite sides. Each sleeve is attached to the body portion over an angle of attachment greater than 180° and less than 300°. A thumb loop is formed at the end of each of the sleeves and is shaped to engage the saddle of the thumb of a wearer. In forming the gown, after the body portion has been cut and the sleeves formed, the sleeves are attached to the body portion by heat sealing half the sleeve, then rotating the sleeve so that a second portion of the sleeve is attached to the gown, with the total angle of attachment not exceeding 300°. A score is provided adjacent the head aperture in the gown to define the pair of tie straps which can be used to create a tighter or looser fit about a wearer's neck, as described.

9 Claims, 2 Drawing Sheets

PROTECTIVE GOWN WITH INTEGRAL TIE STRAPS

This application is a continuation of application Ser. No. 270,246, filed Nov. 14, 1988, abandoned.

BACKGROUND OF THE INVENTION

This invention relates to gowns for use in hospitals and clinics, and more particularly to a disposable protective gown intended for single use applications.

Gowns of the nature of that of the invention are used to protect the wearer, normally from contamination or infection. Various types of gowns have been developed in the past for these purposes. U.S. Pat. No. 4,612,673 discloses a gown which fastens in the front of a patient. U.S. Pat. Nos. 4,504,978 and 4,586,196 disclose a full body gown which fastens behind the wearer. U.S. Pat. No. 4,608,719 discloses a disposable, pullover-type gown with integral arms. U.S. Pat. No. 4,523,335 discloses a rear-fastening gown with tie straps to maintain the gown in place.

U.S. Pat. No. 4,829,602, issued May 16, 1989, of which this application constitutes an improvement, discloses a novel protective gown having a score extending between a central head aperture and one edge of the gown so that the gown can be severed along the score and opposite halves of the severed gown secured to one another with a tape tab in order to reduce the size of the head aperture. Because of the nature of the score, however, a tape tab must be used, and the opposite halves of the severed gown are too short to be tied to one another.

SUMMARY OF THE INVENTION

The present invention relates to a disposable protective gown which is easy to use, is retained properly in place when worn, and which is readily adjustable about the neck of the wearer to accommodate various wearers and their needs for use of the gown. The gown has a body portion having an upper part formed to extend over the shoulders of the wearer. The upper part has a central head aperture so that the gown may be worn in a pullover fashion. A pair of sleeves extends outwardly from opposite sides of the upper part of the gown. A pair of integral neck tie straps is formed in the upper part of the gown, the gown including a score in the upper part extending outwardly at an oblique angle from the head aperture and defining the tie straps on opposite sides of the score.

In accordance with the preferred embodiment of the invention, the upper part of the gown terminates at a rear edge. The score extends between the head aperture and the rear edge in a curvilinear fashion. The score extends from a location at the head aperture proximate one side of the upper part of the gown to a location at the rear edge proximate the other side of the upper part. Thus, the tie straps are of sufficient length so that the head aperture can be either expanded or contracted in size, with the straps being tied to one another to affix the gown about the neck of the wearer.

BRIEF DESCRIPTION OF THE DRAWINGS

The invention is described in greater detail in the following description of an exmple embodying the best mode of the invention, taken in conjunction with the drawings figures, in which.

DESCRIPTION OF AN EXAMPLE EMBODYING THE BEST MODE OF THE INVENTION

Figure 1:
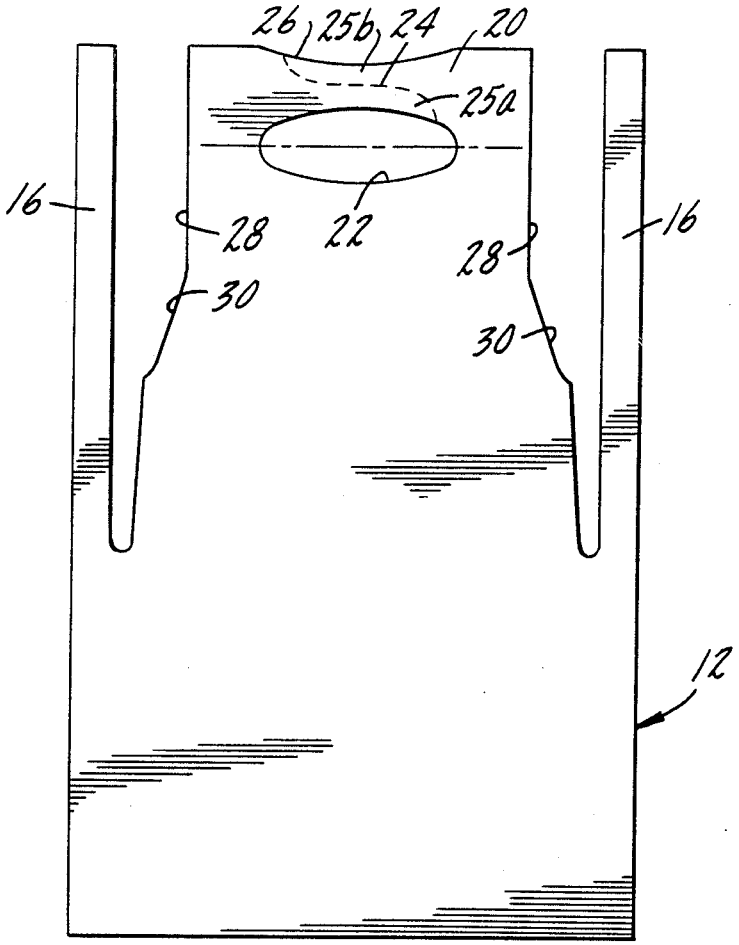
FIG. 1 is a plan view of the body portion of the gown, after it has been cut and scored, but before attachment of the sleeves.

A disposable protective gown according to the invention is shown generally at 10 in the drawing figures. The gown is composed of two basic elements, a body portion 12 and a pair of sleeves 14. As indicated above, the fully assembled gown is illustrated in FIGS. 4 and 5, with portions thereof and steps of the assembly shown in FIGS. 1 through 3.

Figure 4:
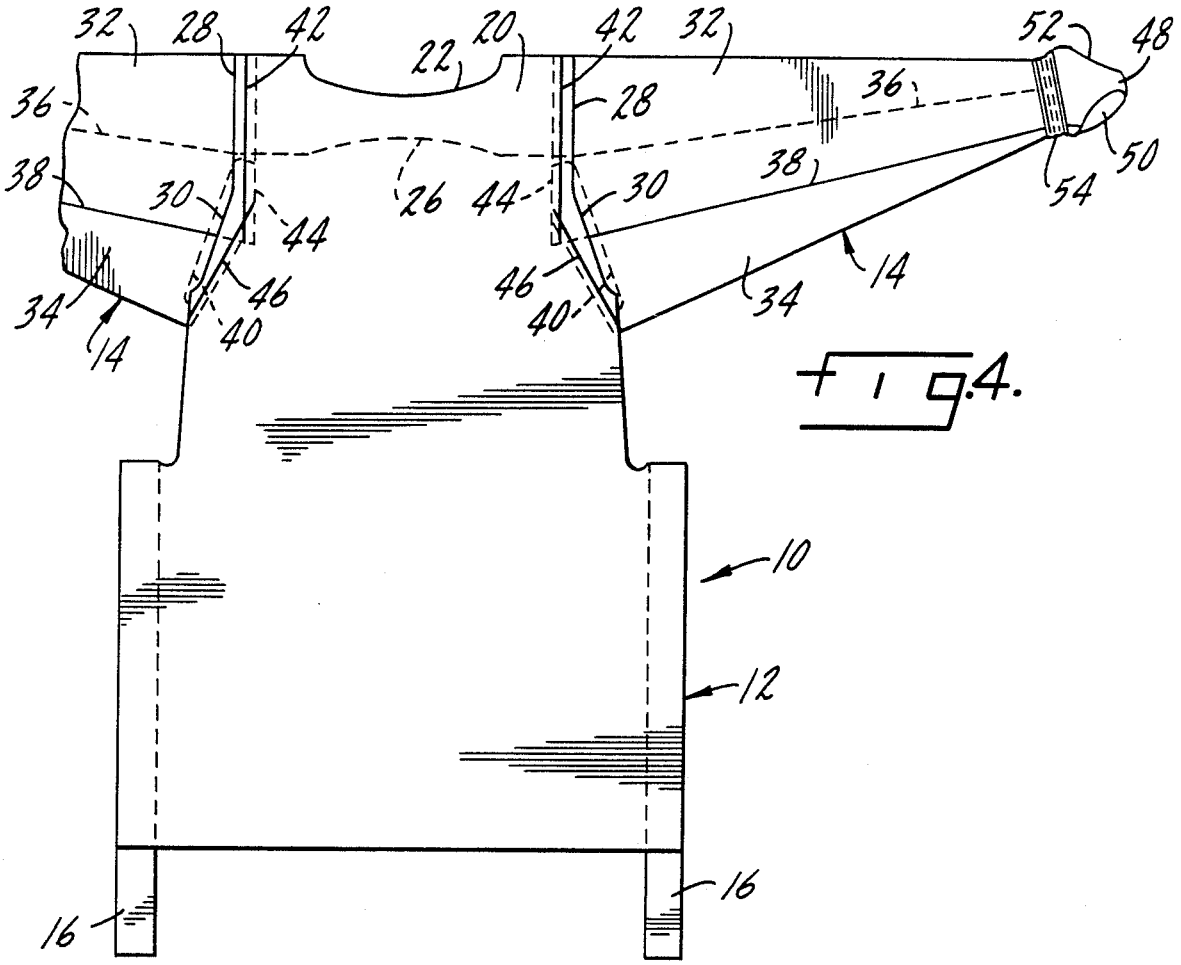
FIG. 4 is a front plan view of the gown illustrated in FIG. 3 with the sleeves fully attached.
Figure 5:
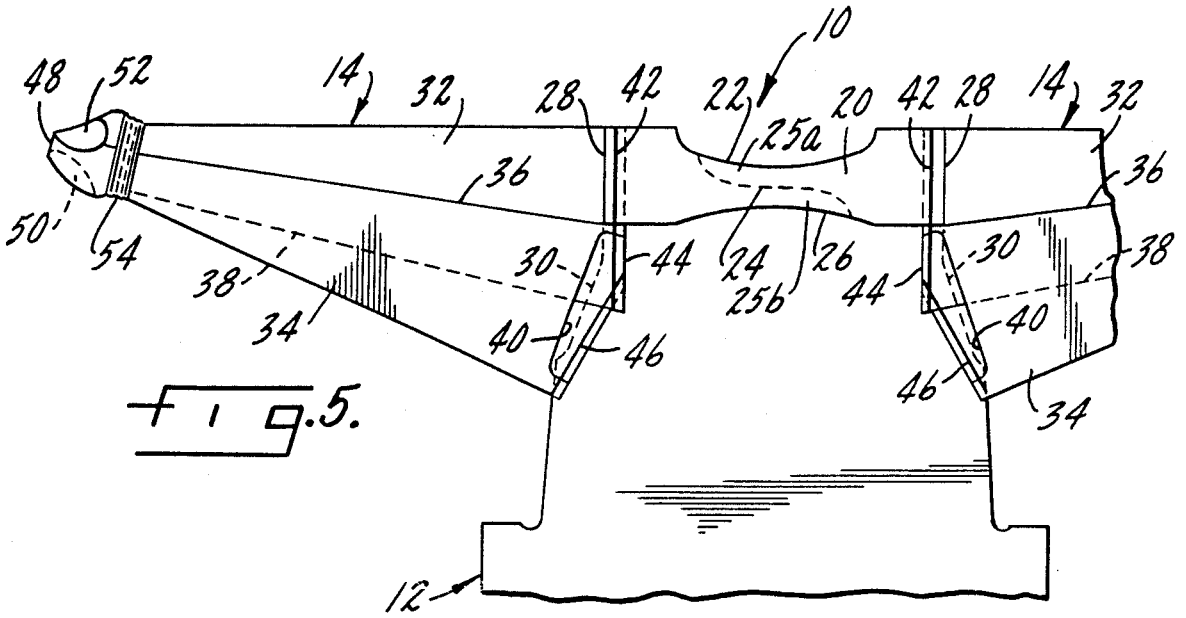
FIG. 5 is a rear plan view, with portions omitted, of the gown shown in FIG. 4.

Turning first to the body portion 12, as best shown in FIG. 1, the body portion 12 is formed from a rectangular sheet of material, such as thin, flexible plastic, and has a pair of integral tie straps 16 cut therefrom and extending from opposite sides, as shown in FIGS. 1 and 4. The tie straps 16 can be quite long so that they can be wrapped about the body of the wearer and tied in front, or each of the tie straps 16 can be long enough to be tied only in the rear.

The body portion includes an upper part 20 which is formed to extend over the shoulders of the wearer of the gown. An oval central head aperture 22 is cut out of the upper part 20. Also formed in the upper part 20 is a score 24 which extends outwardly at an oblique angle in a curvilinear fashion from the head aperture 22 to an edge 26 of the body portion 12, the edge 26 forming the lower extent of the rear of the gown 10 when worn, as best shown in FIG. 5. The score 24 is a weakened tear line, and the gown may be severed at the score 24 to facilitate removal of the gown from the wearer or, if desired for any reason, when the gown 10 is worn, the score 24 can be severed and the severed tie straps **25*a* and 25*b* can then be tied to one another. The gown can be tightly gathered about the wearer's neck, if reduction of the head aperture 22 is desired, or the head aperture can be enlarged by loosely tying the opposite straps 25*a* and 25*b***.

When the tie straps 16 are cut and excess material is severed from the body portion 12, remaining is a first attachment segment 28 which extends parallel to the longitudinal axis of the body portion 12. Also remaining is a second attachment segment 30 which extends outwardly at an oblique angle to the longitudinal axis of the body portion 12. As explained in a moment in connection with the description of FIGS. 3 through 5, the attachment segments 28 and 30 are those locations of the upper part 20 of the body portion 12 to which the sleeves 14 are attached.

The sleeve 14 is formed in the shape of a conical tubular member which may be composed of two separate segments of flexible plastic 32 and 34 which are sealed at their edges by heat seals 36 and 38. The segments 32 and 34 are substantially trapezoidal in shape, with the segment 34 being truncated slightly and further including a circumferential notch 40 which extends substantially for a length equal approximately to that portion of the sleeve 32 that is not attached to the upper part 20, as explained in greater detail below.

The sleeves 14 are attached to the upper part 20 of the body portion 12 over an angle of attachment of greater than 180° and less than 330°. Preferably, the angle of attachment is approximately 270°, or three-fourths of the circumference of the tubular sleeve 14, as shown in the drawing figures. The term angle of attachment is intended to mean that portion of the circumferential dimension of the sleeve 14 that is attached to the upper part 20 of the body portion 12.

Figure 3:
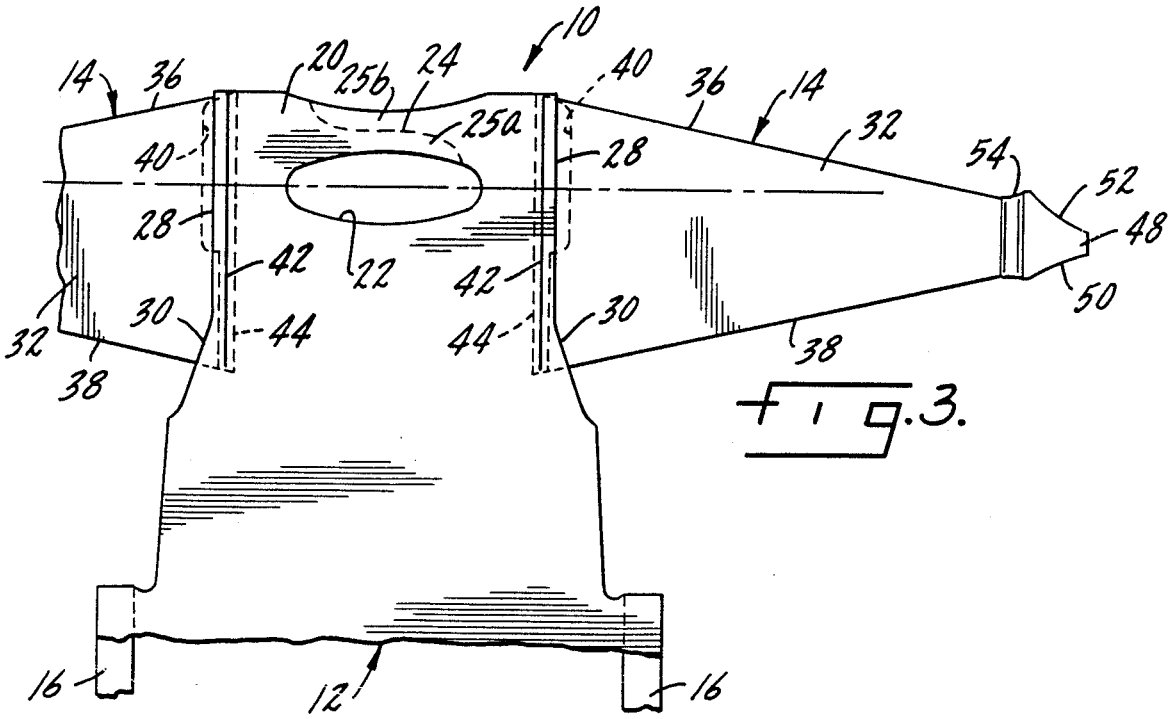
FIG. 3 is a partial plan view of the gown according to the invention, illustrating the first step in the process of attaching the sleeves to the body portion of the gown.

It is important that the sleeves 14 be attached to the body portion 12 over an angle of attachment greater than 180° to ensure that the gown 10, when worn, does not droop forwardly from the shoulders of the wearer. To obtain a greater than 180° attachment, and in order to avoid use of an internal mandrel or other complicated means of attachment of the sleeves 14 to the body portion 12, the sleeves 14 are preferably attached to the body portion in a two step process. The first step is shown in FIG. 3. In that step, each of the sleeves 14 (the right sleeve being the mirror image of the left sleeve, and vice versa), is heat sealed at 42 to the upper part 20 adjacent the first attachment segment 28. As shown in FIG. 3, the end portion 44 of the segment 32 of the sleeve 14 is inserted beneath the attachment segment 28 and is sealed thereto by the first heat seal 42. Because the end portion 44 extends beyond the corresponding end portion of the segment 34 of the sleeve 42, the heat seal 42 does not seal the sleeve 14 closed when being sealed to the upper part 20, but rather seals only the segment 32 of the sleeve 14 to the upper part 20.

After the first heat seal 42 is completed for each of the sleeves 14, the top portion of the upper part 20 is turned beneath the remainder of the upper part 20, as shown in FIG. 4, and a second heat seal 46 is applied to secure a second portion of the sleeve 14 to the upper part 20 adjacent to the second attachment segment 30. The seals 42 and 46 are contiguous or overlap to insure that the area of sealing of the sleeves 14 to the body portion 12 creates a barrier to penetration of any liquids. Because the notch 40 is formed in the piece 34 of the sleeve 14, the sleeve is not sealed to itself, but rather is left unattached to any part of the body portion 12 along the length of the notch 40. Since the notch 40 occupies approximately one half of the width of the segment 34, the aggregate angle of attachment of the sleeve 14 to the body portion 12 as shown in the drawing figures is all but the notch 40, or approximately 270°.

Each sleeve 14 also includes a thumb loop 48 which is shaped to engage the saddle of the thumb of the wearer of the gown 10. The thumb loop 48 has a thumb opening 50 on one side thereof and a fingers opening 52 on the opposite side. When the gown 10 is formed, and as best shown in FIGS. 4 and 5, the thumb opening 50 is located to extend forwardly and downwardly from the gown, in a natural orientation for the wearer so that when the wearer dons the gown 10, as the wearer's arm is inserted within the sleeve 14, the thumb naturally seeks the thumb opening 50, while the fingers naturally seek the fingers opening 52. This orientation also assures that the sleeves 14 of the gown 10, when worn, are not twisted about the arms of the wearer.

The thumb loops 48 of the sleeves 14 serve to prevent the sleeves 14 from "riding up" the arms of the wearer. To aid holding the sleeves 14 in place, and also seal the sleeves about the wrist of the wearer, each of the sleeves 14 may also include an elastic cuff 54 which gathers the sleeve 14 about the wrist of the wearer when the gown 10 is worn.

The thumb loop 48 is preferably heat sealed to the end of each sleeve 14. During the heat sealing process, or separately, an elastic band can be inserted to form the elastic cuff 54. Other, conventional means of forming an elastic cuff can be employed, as desired.

The gown 10 is formed in a relatively straight forward manner. The body portion 12 is formed from a sheet of thin, heat sealable plastic or the like, cut along the lines of the attachment segments 28 and 30 and with the portion between the tie straps 16 and segments 28 and 30 being removed. At the same time, the head aperture 22 and score 24 are formed.

Figure 2:
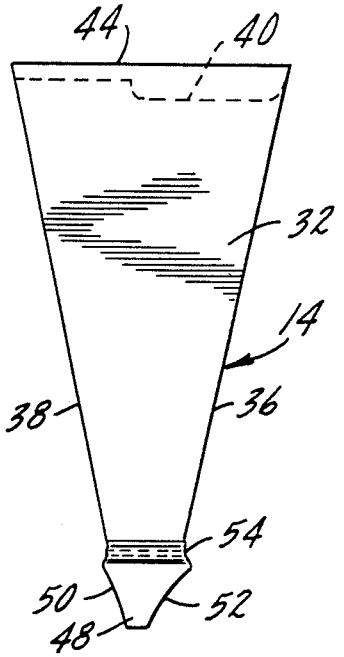
FIG. 2 is a plan view of one assembled sleeve before attachment of the body portion of the gown.

Separately, the sleeves 14 are formed as shown in FIG. 2 and explained above, with the pieces 32 and 34 being heat sealed to one another along the edge heat seals 36 and 38, and with the thumb loop 48 and elastic cuff 54 formed at the smaller end of the sleeve 14.

Thereafter, each of the sleeves 14 is secured to the upper part 20 of the body portion 12. A first portion of the wider end of each of the sleeves 14, comprising the width of the segment 32, is heat sealed at 42 to the upper part 20 along the first attachment segment 28. This results in an angle of attachment of approximately 180°, since approximately one half of the sleeve is attached at this time. Thereafter, the sleeve and upper part 20 are rotated, and a second portion of each sleeve 14 is heat sealed at 46 to the upper part 20 of the body portion 12 along the second attachment segment 30, with the angle of attachment of this second portion of each of the sleeves 14 being greater than 0° and less than 120°, such that the aggregate angle of attachment of each of the sleeves 14 to the upper part 20 is greater than 180° and less than 300°. As explained above, the angle of attachment shown in FIGS. 4 and 5 is approximately 270°, or three-fourths of the circumferential dimension of each of the sleeves 14. Because each of the pieces 34 is truncated slightly shorter than the corresponding pieces 32 of the sleeves 14 and due to the use of the notch 40, each of the sleeves 14 is sealed only to the upper part 20 of the body portion 12 without inadvertent sealing of portions of the sleeves to one another.

By means of its material and process of formation, the gown 10 is quite waterproof and contamination resitant. Because the heat seals 42 and 46 adjoin or overlap, the seal of the sleeves 14 to the body portion 12 is waterproof. Also, the elastic cuffs 54 are preferably heat sealed to the sleeves 14 as well, rather than being sown as conventional, eliminating needle holes and gaps as possible locations for entry of fluids and contaminants.

The score 24, which extends from the edge 26 to the neck aperture 22, permits the gown to be severed in that location. This allows the gown to be tightly gathered around the wearer's neck, which again reduces the chances of fluid and contaminant entry. Alternatively, the straps **25*a* and 25*b* can be tied to one another to enlarge the neck aperture 22, if desired. This is particularly advantageous for larger wearers of the gown, since enlarging the neck aperture 22** also extends the width of the gown across the shoulders of the wearer, providing a more comfortable fit for those requiring a larger gown.

Various changes can be made to the invention without departing from the spirit thereof or scope of the following claims.

We claim:

1. A disposable protective gown comprising a. a body portion having an upper part formed to extend over the shoulders of the wearer of the gown, said upper part having a central head aperture shaped to accomodate a wearer's head passing therethrough without severing of any portion of said upper part, b. a pair of sleeves extending outwardly from opposite sides of and secured at one end to said upper part, and c. means forming a pair of integral neck tie straps in said upper part, including a severable score in said upper part extending outwardly at an oblique angle from said head aperture and defining said tie straps on opposite sides of said score, said score being normally unsevered.

2. A disposable protective gown according to claim 1 in which said upper part terminates at a rear edge of said gown, said score extending between said head aperture and said rear edge.

3. A disposable protective gown according to claim 2 in which said score extends in a curvilinear fashion between said head aperture and said rear edge.

4. A disposable protective gown according to claim 2 in which said score extends from a location at said head aperture proximate one side of said upper part to a location at said rear edge proximate the other side of said upper part.

5. A disposable protective gown according to claim 2 in which one of said tie straps is located between said score and said rear edge, and the other of said tie straps is located between said score and said head aperture.

6. A disposable protective gown comprising a. a body portion having an upper part formed to extend over the shoulders of the wearer of the gown, said upper part having a central head aperture and extending to a rear edge of said gown, said head aperture being shaped to accomodate a wearer's head passing therethrough without severing of any portion of said upper part, b. opposite sides of said upper part formed for attachment of sleeves thereto, and c. means forming a pair of complementary, integral neck tie straps in said upper part, said means forming including a severable score in said upper part extending at an oblique angle between said head aperture and said rear edge and defining said tie straps on opposite sides of said score, said score being normally unsevered.

7. A disposable protective gown according to claim 6 in which said score extends in a curvilinear fashion between said head aperture and said rear edge.

8. A disposable protective gown according to claim 6 in which said score extends from a location at said head aperture proximate one side of said upper part to a location at said rear edge proximate the other side of said upper part.

9. A disposable protective gown according to claim 6 in which one of said tie straps is located between said score and said rear edge, and the other of said tie straps is located between said score and said head aperture.

* * * * *